US008567163B2

(12) United States Patent
Præstholm

(10) Patent No.: US 8,567,163 B2
(45) Date of Patent: Oct. 29, 2013

(54) METHOD FOR PACKAGING ARTICLES

(75) Inventor: Jan Præstholm, Vipperød (DK)

(73) Assignee: Rockwool International A/S, Hedehusene (DK)

( * ) Notice: Subject to any disclaimer, the term of this patent is extended or adjusted under 35 U.S.C. 154(b) by 475 days.

(21) Appl. No.: 12/808,512

(22) PCT Filed: Dec. 15, 2008

(86) PCT No.: PCT/EP2008/067513
§ 371 (c)(1),
(2), (4) Date: Sep. 13, 2010

(87) PCT Pub. No.: WO2009/080582
PCT Pub. Date: Jul. 2, 2009

(65) Prior Publication Data

US 2011/0011035 A1 Jan. 20, 2011

(30) Foreign Application Priority Data

Dec. 21, 2007 (EP) ..... 07123974

(51) Int. Cl.
*B65B 63/02* (2006.01)
*B65B 39/02* (2006.01)

(52) U.S. Cl.
USPC ..... 53/438; 53/529; 53/257; 53/258

(58) Field of Classification Search
CPC ..... B30B 9/3025; B30B 9/30; B65B 27/125; B65B 63/026; B65B 39/02; B65B 63/02
USPC ..... 53/438, 439, 528–530, 257, 258; 100/41, 179, 191
IPC ..... B65B 63/02,39/02
See application file for complete search history.

(56) References Cited

U.S. PATENT DOCUMENTS

| | | | | | |
|---|---|---|---|---|---|
| 231,215 | A | * | 8/1880 | Dederick | 53/258 |
| 715,450 | A | * | 12/1902 | Wuest, Jr. | 53/257 |
| 856,445 | A | * | 6/1907 | Coffman | 100/242 |
| 2,073,655 | A | * | 3/1937 | Spafford | 100/191 |
| 4,047,362 | A | * | 9/1977 | Lister et al. | 53/258 |
| 4,094,130 | A | * | 6/1978 | Kelly et al. | 53/529 |
| 4,096,595 | A | * | 6/1978 | Eide et al. | 53/438 |
| 4,300,327 | A | * | 11/1981 | Bridger | 53/258 |
| 4,489,648 | A | * | 12/1984 | Naaktgeboren | 100/191 |
| 4,679,379 | A | * | 7/1987 | Cassoli | 53/438 |
| 5,127,212 | A | * | 7/1992 | Johnsen et al. | 53/540 |
| 5,564,261 | A | * | 10/1996 | Kiner | 53/439 |
| 6,161,365 | A | * | 12/2000 | Girard et al. | 53/441 |

FOREIGN PATENT DOCUMENTS

| | | | | |
|---|---|---|---|---|
| EP | 349226 | A1 | * | 1/1990 |
| JP | 04189720 | A | * | 7/1992 |
| NL | 122776 | C | | 8/1967 |

* cited by examiner

*Primary Examiner* — Stephen F Gerrity
(74) *Attorney, Agent, or Firm* — Gifford, Krass, Sprinkle, Anderson & Citkowski, P.C.

(57) ABSTRACT

An apparatus for packaging articles, in particular a stack of insulation panels, includes an element for supplying a stack of articles to a transfer position, and an adjustable spout forming a discharge channel having a receiving end and a distal end. The apparatus is further operative to wrap the stack with a packaging foil material, and transfer it into the spout. The adjustable spout comprises at least four spout members which are moveable relative to each other so as to vary the height and the width of the spout.

14 Claims, 3 Drawing Sheets

METHOD FOR PACKAGING ARTICLES

CROSS-REFERENCE TO RELATED APPLICATIONS

This application is the U.S. national phase of PCT/EP2008/067513 filed Dec. 15, 2008, which claims priority of European Patent Application No. 07123974.3 filed Dec. 21, 2007.

FIELD OF THE INVENTION

The present invention relates to an apparatus and a method for packaging articles, in particular a stack of insulation panels, comprising means for supplying a stack comprising one or more articles to a transfer position, an adjustable spout providing a discharge channel and having a receiving end and a distal end and with packaging means provided adjacent the distal end, so that the stack is received at the receiving end and discharged at the distal end provided with a packaging foil material, and means for transferring said stack in a transfer direction into the spout.

BACKGROUND OF THE INVENTION

From U.S. Pat. No. 4,094,130 an apparatus for packaging articles of this kind is known. The articles are supplied in a stack and compressed and then discharged through a bagging spout for applying a bag to the compressed stack of articles. The bagging spout is longitudinally divided into two laterally moveable halves each having a U-shaped cross-section. Hereby the spout can be adjusted to different widths of the articles by moving the two halves towards or away from each other.

In the production of insulation materials, insulation batts are produced with different sizes, e.g. ranging from 400 mm (16") to 600 mm (24") in width. The stacks of compressible fibrous insulation material are compressed and bagged in a packaging apparatus. To compensate for the different sizes, different sizes of the packaging bags are used.

SUMMARY OF THE INVENTION

Today, two sizes of packaging bags are used for the production of various packages of fibrous insulation material.

Hence, it is an object by the present invention to provide an improved apparatus and method for packaging of articles, in particular fibrous insulation panels or batts provided for packaging in a bag.

This object is achieved by an apparatus and a method of the initially mentioned kind, wherein the adjustable spout comprises at least four spout members, where a plurality of the spout members are moveable relative to each other in one or more directions perpendicular to the transfer direction for increasing or decreasing the height and the width of the spout.

According to the invention, the spout is adjustable in both width and height which is advantageous for several reasons. The ability to adjust the spout to the size of the stack and not only to the width of the articles therein allows for a more efficient production of packages of insulation products and an improved quality thereof. Moreover, a method and an apparatus according to the invention allow for the use of standard sized packaging bags for different packaging jobs, i.e. different widths of the articles.

By the invention it becomes possible to produce more accurate predetermined packages sizes. The packages of insulation batts are preferably produced having the same quantity in each package irrespective of the insulation batt size, e.g. packages produced with a predetermined weight or a predetermined area, i.e. square meters, irrespective of the size of the insulation batts in the package. This facilitates the end-users as it is easier to predict the required amount of insulation material packages needed for a particular insulation job. Moreover, the invention is also advantageous in terms of production costs since it is possible to use to same bag size for all types of insulation batts. By producing to the same quantity for all widths of insulation material, the circumference of the spout is preferably kept the same although the spout is adjusted in height and width.

When packaging fibrous insulation batts, the products are somewhat compressed, so that more insulation material can be provided in the bag in a compact manner. However, there is a limit to the degree of compression that the products can be subjected to without deteriorating the products. This maximum compression degree is for instance 50% reduction of the height of the stack. By the prior art solutions, the compression degree varies depending on the thickness of the products because in order to fit as many products into the packaging bag without exceeding the compression limit. This results in variations of amounts of batts in a package simply because of the thickness of the products and therefore a variation in the packaging degree for some products. According to the invention, the spout may be adjusted in one dimension in order to package a stack of products having a certain width. However, by the invention it is realised that the packaging degree, i.e. the degree of compression, may be optimised better since it is possible finely adjust the spout in the dimension perpendicular to this first dimension, such as the height of the spout. Hereby, it is possible to produce more evenly compressed packages even if the packages comprise different sizes of products, such as products having different widths and/or different thicknesses. The packages hereby obtained may also be optimised so that more products in the stack, such as a stack of compressed fibrous insulation batts having a certain size, can be fitted in the bag without exceeding the compression limit for the products.

In order to fill the packaging bag, in particular for smaller sizes, it is realised that the stack of insulation batts may be turned so the insulation batts are oriented vertically rather than horizontally in the stack as it is entered into the spout. Hereby, the visual appearance of the finished packages is taken into consideration as the manufacturer's logo, which is pre-printed on the bag, may be uniformly positioned on the sides of the finished packages irrespective of size.

In the preferred embodiment, the spout members are forming a cylindrical discharge channel having a substantially rectangular cross-section. This ensures a correct filling and maintains a cubic configuration of the packages.

According to a preferred embodiment of the invention, four spout member each form a corner of the spout and two mutually perpendicular side members on each side of said corner portion. This allows for adjustments in width and height in a range where the maximum spout opening is double in width and/or height compared to the minimum spout opening. To extend the adjustment range further, intermediate, substantially flat, side spout members may also be provided in the vertical and/or the horizontal side sections of the spout.

In a preferred embodiment, a first spout member is provided with a fixed position and that the further spout members are moveable relative to said first spout member. Preferably, a second spout member is provided adjacent said first spout member and movable in a direction parallel to the first side member of the first spout member. Moreover, a third spout member is preferably provided adjacent said first spout member and movable in a direction parallel to the second side member of the first spout member. Preferably, a fourth spout member is provided diagonally opposite said first spout member and movable in the directions parallel to both the first and second side members of the first spout member. These construction measures individually as well as in combination contribute to providing a predetermined reference for the stack when it is transferred into the adjustable spout according to the invention.

Preferably, the second and fourth spout members are movable together by first adjustment means, and preferably the third and fourth spout members are movable together by second adjustment means. This allows for a simple and reliable control of the adjustment of the spout in an apparatus and a method according to the invention.

In a method and an apparatus according to the invention, the packaging foil is a bag, which is either manually or automatically prepared for receipt of a stack prior to the transfer of the stack through the spout. Accordingly, the apparatus may preferably comprise means for providing a packaging bag in a predetermined position on the outside of the spout thereby blocking the distal end of said spout.

In a preferred embodiment of the invention, means for compressing the stack of at least one article are provided at the transfer position. Hereby, the stack of articles, such as fibrous insulation panels, are compressed in height and then pushed into the spout by a piston or the like. Accordingly, the packaging material of the bag may be non-expanded when provided on the spout.

However, alternatively it is realised that by the present invention the packaging material of the bag may be a stretchable foil. Hereby, the stack of materials need not be compressed prior to being entered into the spout. Instead the bag may be elastically expanded on the spout by moving the spout members somewhat away from each other.

BRIEF DESCRIPTION OF THE FIGURES

In the following, the invention is described in more detail with reference to the accompanying drawings, in which.

DETAILED DESCRIPTION OF THE INVENTION

Figure 1:
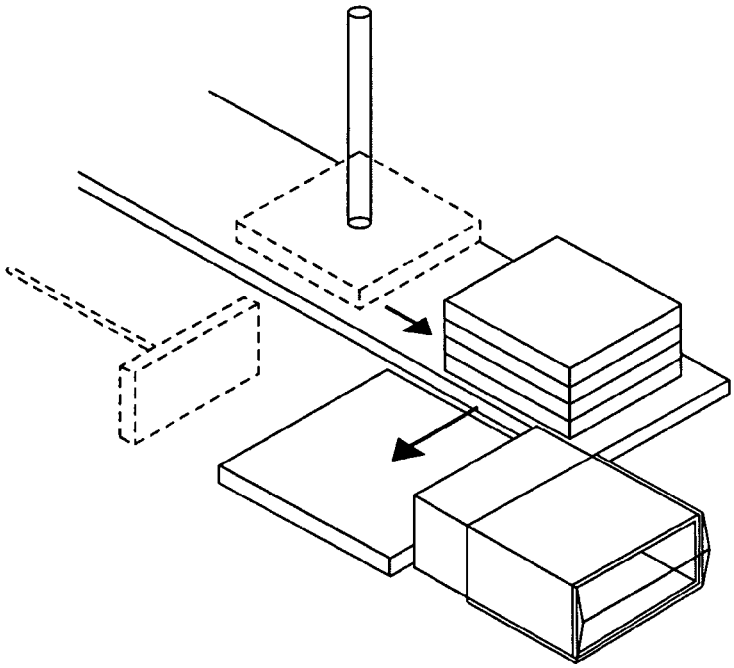
FIGS. 1 to 4 show the steps of a packaging process for bagging fibrous insulation batts.
Figure 2:
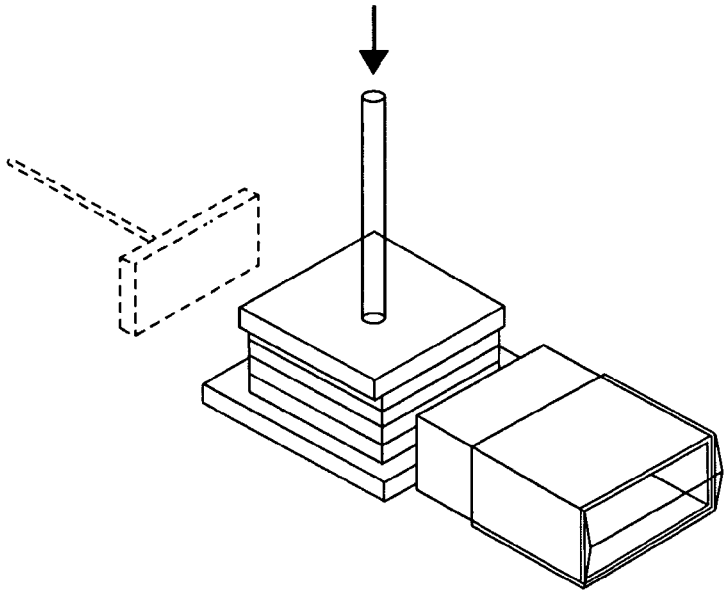
Figure 3:
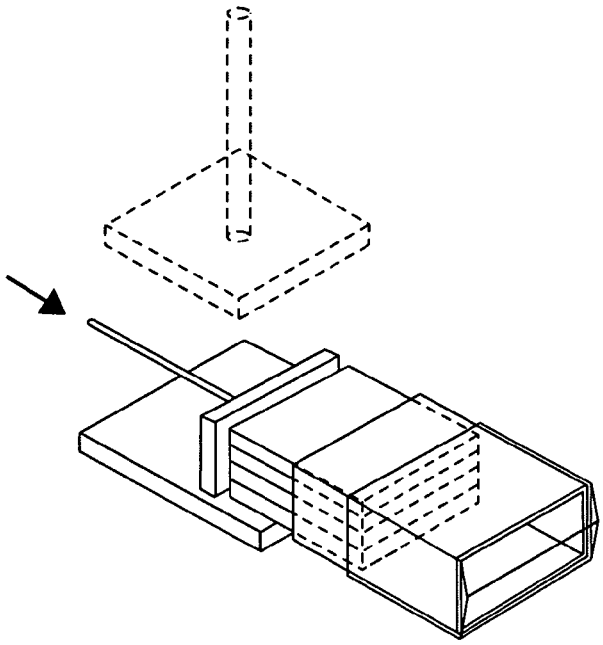
Figure 4:
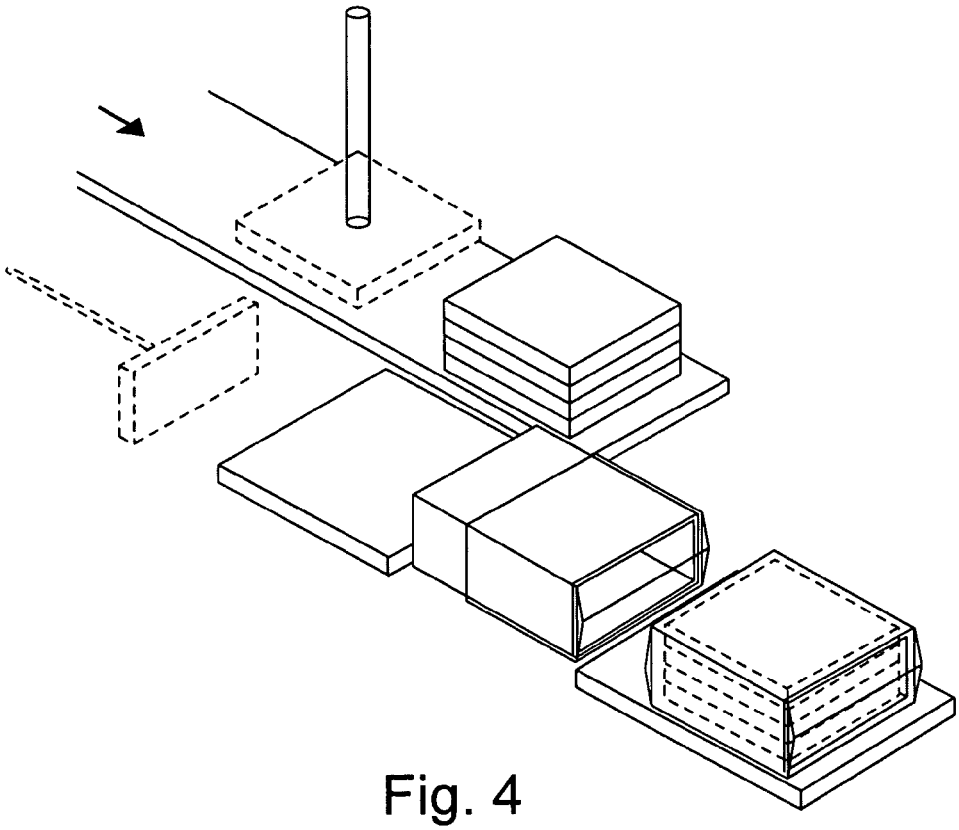

With reference to FIGS. 1 to 4, an example of a packaging process for packaging a stack of fibrous insulation batts in a bag is shown. A stack of articles 1 is supplied on a conveyor 2 and transferred to a transfer position 3 where the stack 1 is compressed by a compression plate 4 or the like being forced onto the top of the stack 1. Adjacent the transfer position 3 a spout 5 is provided. The spout 5 has a receiving end at the transfer position 3 and extends in a transfer direction and terminates with a distal end. On the distal end of this spout 5, a packaging bag 6 is arranged and ready to receive the stack 1 of insulation batts.

On the transfer position 3 opposite the spout 5, seen in the direction of transfer, there is provided a piston 7, which is moveable in the transfer direction of the articles and pushes the compressed stack 1 into the receiving end of the spout 5 and through the spout 5 and into bag 6. The stack 1 is hereby inserted into the bag 6 which is automatically drawn off the spout 5 by the piston 7 in one and the same movement as the filling. After the bag 6 is drawn off the spout 5, a welding action (not shown) is performed on the bag whereby the packaged insulation material is sealed inside the bag and the package 8 is ready for further processing, such as being taken away for storage and/or transportation.

Figure 5:
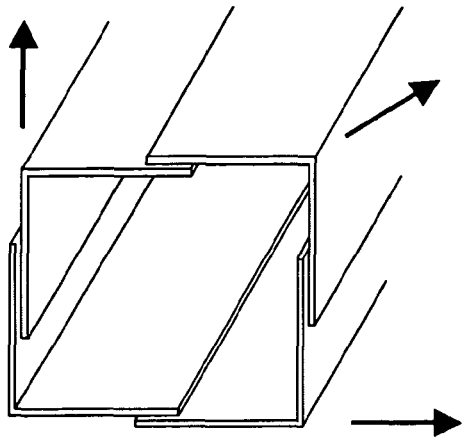
FIG. 5 is a schematic cross-section view of a spout of an apparatus according to an embodiment of the invention.
Figure 6:
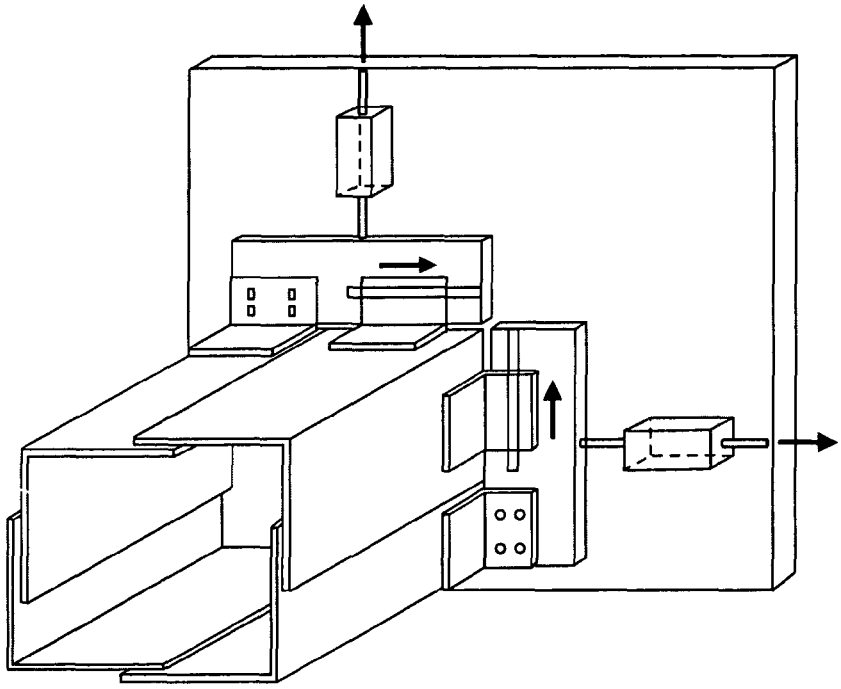
FIG. 6 is a schematic perspective view of the front end of an apparatus according to an embodiment of the invention.

In FIGS. 5 and 6, there is shown a spout 5 according to a preferred embodiment of the invention, where the spout 5 comprises four spout members 51, 52, 53, 54. The spout members 51, 52, 53, 54 each form a corner in the substantially rectangular spout 5 and two mutually perpendicular side members 55, 56 on each side of their corner portions. This allows for adjustments in width and height in a range where the maximum spout opening is double in width and/or height compared to the minimum spout opening. In a further embodiment, intermediate, substantially flat, side spout members (not shown in the figures) may also be provided in the vertical and/or the horizontal side sections of the spout to extend the adjustment range further.

As indicated by the arrows in FIG. 5, the first spout member 51 is in fixed position and that the further spout members 52, 53, 54 are moveable relative to said first spout member. The second spout member 52 is provided adjacent the first spout member 51 and movable in a direction parallel to the first side member 56 of the first spout member. Moreover, the third spout member 53 is preferably provided adjacent the first spout member 51 and movable in a direction parallel to the second side member 55 of the first spout member 51. Furthermore, the fourth spout member 54 is provided diagonally opposite the first spout member 51 and movable in two directions, i.e. both parallel to the first and second side members 55, 56 of the first spout member 51 and as well as moveable in a diagonal direction. These construction measures individually as well as in combination contribute to providing a predetermined reference for the stack when it is transferred into the adjustable spout according to the invention.

In a preferred embodiment of the invention, the spout 5 may be adjusted within a range of approx. 16" (400 mm) to 24" (600 mm) in width in width and within a range of 10" to 24" in the height of spout, more preferably 12" to 20" in height adjustment range. In an example, the length of products is approx. 1200 mm (48"). In this relation, it is found preferable that the length of spout is preferably approx. 1000 mm, so that the bag is not too loosely fitted on the spout. Thus, the spout is provided with a sufficient length corresponding to the products which provides sufficient support for the bag so that the bag is not excessively wrinkled when fitted on the spout since this could cause damages to the bag as it is drawn off the spout. During the filling of products into the bag, the air inside the bag must be able to escape as the air inside the bag is being replaced by the products. To ensure that the air is not trapped inside the bag, the spout may be adjusted to a slight oversize so that air can escape along the sides of the stack of products and the inner walls of the spout. As an alternative or a supplement, the bag may be provided with perforations in the end portion, e.g. provided in the welding or adjacent the welding in the end portion covering the distal end opening of the spout.

Generally, the data in the table below provide examples of the production capacity of an apparatus according to the invention:

TABLE 1

| | Range | Unit |
|---|---|---|
| Generally | | |
| Density of insulation articles | 28 to 94 | $kg/m^3$ |

TABLE 1-continued

| | Range | Unit |
|---|---|---|
| Stacks | | |
| Product length | ~1200 | mm |
| Product width | 380 to 620 | mm |
| Product thickness | 25 to 190 | mm |
| Compression height | ~250 to ~500 | mm |
| Output (bags) | | |
| Length | ~1200 | mm |
| Width | ~480 to ~620 | mm |
| Height | ~300 to ~450 | mm |
| Weight of bag | ~16 to ~30 | kg |

As indicated in the table above, the density of insulation material may range from approx. 28 kg/m$^3$ to 94 kg/m$^3$. This range is in relation to compressible insulation materials. However, it is realised by the invention that a stretchable foil may be used for the bag and stretched when mounted around the outside of the spout, whereby there is no limit to the range of densities for which this packaging apparatus and method is suited.

Typically, fibrous insulation material products are produced with predetermined widths, such as 400 mm, 500 mm, 600 mm and some times 800 mm in width in some markets. The spout according to the invention is adjustable to all of these sizes and is therefore well suited for the production of all the types of products.

With reference to FIG. 6, the second and fourth spout members 52, 54 are movable together by first adjustment means 9, and the third and fourth spout members 53, 54 are movable together by second adjustment means 10. This allows for a simple and reliable control of the adjustment of the spout in an apparatus and a method according to the invention. The adjustment means 9, 10 may comprise linear actuators moving the spout members 52, 53, 54 in vertical and/or horizontal guide rails for providing the required movements and thereby adjusting the spout opening size.

The spout is preferably made of stainless steel but other types of steel could also be used for some or all of the spout members. Preferably, the spout is provided with friction reducing coating both on the inside and on the outside. On the inside, this ensures and the stack slides easily even as the stack attempts to expand inside the spout. On the outside the non-friction surface is advantageous because it facilitates the fitting of the bag and ensures that the bag will slide off the spout as it is being filled without being damaged.

The invention is described above with reference to some preferred embodiments. However, it is realised that variants to these embodiments may be provided without departing from the scope of the invention as set forth in the accompanying claims.

The invention claimed is:

1. A method of packaging stacks of insulation panels, said method comprising the steps of:

supplying a plurality of stacks, each stack comprising a plurality of insulation panels to a transfer position, at least some of the stacks having a first width and at least some of the stacks having a second width different from the first width;

transferring each stack in a transfer direction into an adjustable spout having a discharge channel with a receiving end and a distal end;

wherein said adjustable spout has a specific circumference;

wherein the adjustable spout comprises at least four spout members;

wherein the at least four spout members form said discharge channel and form a substantially closed rectangular cross-section;

providing a plurality of foil material packages, each package being the same size and being received on the distal end of the discharge channel of the adjustable spout;

adjusting the adjustable spout in two directions perpendicular to the transfer direction for increasing or decreasing the height and the width of the adjustable spout according to the size of each stack which is supplied for packaging;

maintaining the specific circumference of the spout the same although the adjusted spout has been adjusted in height and width to accommodate stacks having the first width and stacks having the second width such that each of the stacks is packaged in one of the same sized packages;

discharging each stack through the distal end of the discharge channel of the adjusted spout and into one of provided same sized packages received on the adjusted spout.

2. A method according to claim 1, where each of the four spout members forms a corner of the spout and two mutually perpendicular side members on each side of said corner.

3. A method according to claim 1, where a first spout member is provided with a fixed position and that the further spout members are moveable relative to said first spout member.

4. A method according to claim 3, where a second spout member is provided adjacent said first spout member and moveable in a direction parallel to a first side member of the first spout member.

5. A method according to claim 3, where a third spout member is provided adjacent said first spout member and moveable in a direction parallel to a second side member of the first spout member.

6. A method according to claim 3, where a fourth spout member is provided diagonally opposite said first spout member and moveable in directions parallel to both a first and a second side member of the first spout member.

7. A method according to claim 3, where the second and fourth spout members are moveable together by first adjustment means.

8. A method according to claim 3, where the third and fourth members are moveable together by second adjustment means.

9. A method according to claim 1, where the foil material packages are bags, each of which is inserted in a predetermined position on the outside of the spout thereby blocking the distal end of said spout.

10. A method according to claim 1, further comprising compressing the stack of insulation panels at the transfer position.

11. A method according to claim 1, where the foil material packages are a stretchable foil.

12. A method according to claim 1, where the foil material packages are non-expanded when provided on the spout.

13. A method according to claim 1, further comprising compressing the stack of insulation panels.

14. A method according to claim 12, where the foil material packages are a foil for retaining the compression of the stack of insulation panels.

* * * * *